US006112340A

United States Patent [19]

Ziebert et al.

[11] Patent Number: 6,112,340

[45] Date of Patent: Sep. 5, 2000

[54] HOT TUB AND SPA COVER AND METHOD OF MAKING SAME

[76] Inventors: Philip D. Ziebert, 30856 Izaak Walton Rd.; Ty Furlanic, 2852 Willomette St., #255, both of Eugene, Oreg. 97405

[21] Appl. No.: 09/191,271

[22] Filed: Nov. 12, 1998

Related U.S. Application Data

[60] Provisional application No. 60/065,346, Nov. 12, 1997.

[51] Int. Cl.[7] ..... E04H 4/00

[52] U.S. Cl. ..... 4/498; 4/580

[58] Field of Search ..... 4/498, 580, 583, 4/503; 428/212, 71, 424.2, 424.8

[56] References Cited

U.S. PATENT DOCUMENTS

| | | | |
|---|---|---|---|
| 4,422,192 | 12/1983 | Jacobs | 4/498 |
| 4,857,374 | 8/1989 | Perry | 428/71 |
| 5,022,101 | 6/1991 | Gosselin et al. | 4/498 |
| 5,086,525 | 2/1992 | Christopher | 4/498 |
| 5,386,597 | 2/1995 | O'Neill | 4/498 |
| 5,398,350 | 3/1995 | Watkins et al. | 4/498 |
| 5,619,759 | 4/1997 | Hansen et al. | 4/498 |
| 5,924,144 | 7/1999 | Peterson | 4/448 |

OTHER PUBLICATIONS

J.R. Enterprises Inc., Hardshell, Feb. 11, 1997.
Be–Lite, Inc./Cut Covers, Top It Right, Oct. 1994.

*Primary Examiner*—David J. Walczak
*Assistant Examiner*—Huyen Le
*Attorney, Agent, or Firm*—Steven J. Adamson

[57] ABSTRACT

A hot tub cover that is lightweight, durable, watertight and economically fabricated. The cover includes a water-tight exterior that surrounds insulation material, typically of foam or the like. In a preferred embodiment, the exterior is provided with mechanisms that permit thermal expansion of the exterior relative to the insulation material. The provision of thermal expansion buffer material and air gaps between the insulation material and exterior layer is also disclosed as are joinder and skirt attachment mechanisms.

15 Claims, 3 Drawing Sheets

HOT TUB AND SPA COVER AND METHOD OF MAKING SAME

CROSS REFERENCE TO RELATED APPLICATIONS

This application claims the benefit of U.S. Provisional application Ser. No. 60/065,346, filed Nov. 12, 1997, and having the same title and inventors as above.

FIELD OF THE INVENTION

The present invention relates to hot tub and spa covers and methods of making same.

BACKGROUND OF THE INVENTION

Several types of prior art hot tub and spa covers (hereinafter referred to collectively as "hot tub" covers) are known. One type of prior art hot tub cover is formed of a flexible vinyl material sewn around foam. This type of cover is disadvantageous for several reasons including the following.

The flexible vinyl used on these covers and/or the manner of joining the vinyl sections is not water-tight which results in the accumulation of moisture inside the hot tub cover. This moisture significantly increases the weight of the hot tub cover, causing deformation (e.g., sagging) and making removal from or replacement on a hot tub significantly more difficult. The extra weight also causes additional mechanical stress which may result in mechanical failure such as foam breakage and the tearing of hinges, seams, or handle attachments. Moisture accumulations may also lead to the growth of microorganisms that degrade component quality.

Additional aspects of these hot tub covers include that the environmental conditions in which they are used tend to cause undesirably rapid degradation of the vinyl material and the thread used to sew vinyl sections together.

Other prior art hot tub covers have attempted to improve upon the above described cover or on other predecessors. These attempts include providing multiple layers of material to try to prevent moisture penetration, increasing structural integrity by (1) increasing the thickness of the insulating foam or (2) providing sometimes complicated support structures and utilizing other materials and configurations to improve a particular performance characteristic.

In general, however, prior art hot tub covers are disadvantageous in that they have failed to produce a cover that is strong, durable (i.e., able to withstand mechanical and environmental stress), efficiently made, inexpensive in both materials and manufacture and that does not accumulate moisture.

SUMMARY OF THE INVENTION

Accordingly, it is an object of the present invention to provide a water-tight, lightweight, durable and inexpensive hot tub cover.

It is another object of the present invention to provide such a hot tub cover that is structurally strong and resilient to physical surface damage.

It is another object of the present invention to provide such a hot tub cover that is designed to use a minimal amount of material.

It is also an object of the present invention to provide a hot tub cover that compensates for materials that have differing coefficients of expansion.

These and related objects of the present invention are achieved by use of a hot tub and spa cover and method of making same described herein.

The attainment of the advantages and features of the invention should be more readily apparent to those skilled in the art, after review of the following more detailed description of the invention taken together with the drawings.

DETAILED DESCRIPTION

Figure 1:
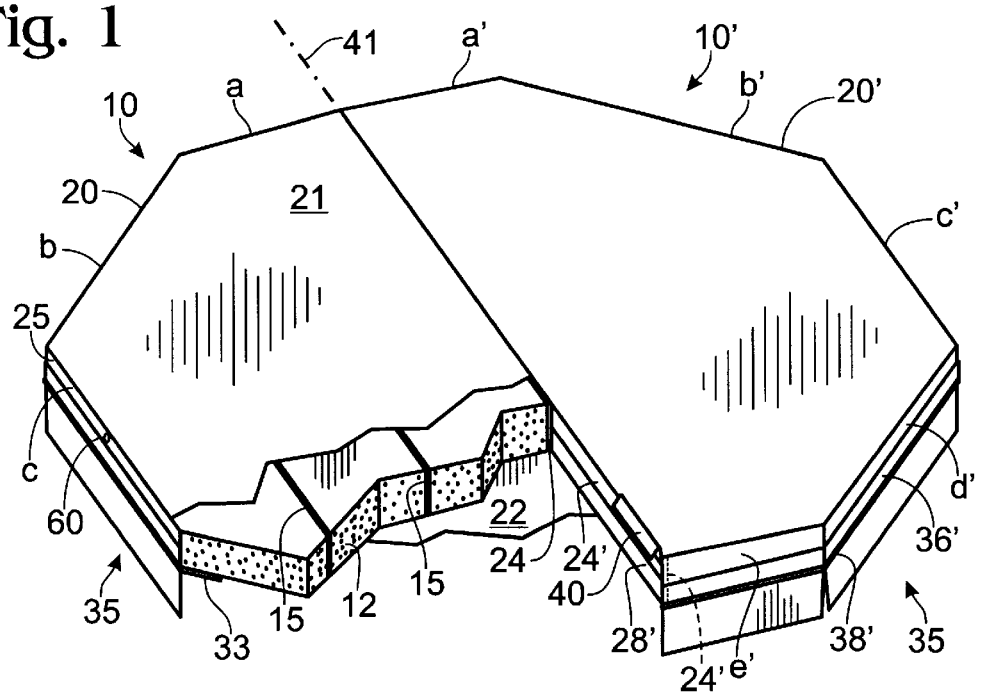
FIG. 1 is a cut-away perspective view of a hot tub cover in accordance with the present invention.

Referring to FIG. 1, a cut-away perspective view of a hot tub cover 5 in accordance with the present invention is shown. Cover 5 may be divided into two generally symmetrical halves 10,10' joined by a hinge 40 (only a portion of which is shown in FIG. 1). While half 10 (and half 110, discussed below) is described in the text which follows, it is to be understood that half 10' is preferably the same as half 10 in construction. It should also be understood that while the hot tub covers of the present invention preferably include a hinge, this is not a limitation of the present invention which includes hot tub covers made without a hinge (i.e., as a single piece or a sectional). Furthermore, while symmetrical arrangements are preferred, this is also not a limitation. The geometric shape of the hot tub cover is largely dependent on the geometry of the hot tub that the cover is designed to fit and thus, will vary as hot tubs vary.

Half 10 of hot tub cover 5 includes thermal insulation material 12 which is preferably expanded polystyrene (EPS) foam or the like.

The foam is preferably covered by an outer layer 20 of water-tight material, where water-tight means that the material is generally impermeable to water in liquid or vapor form, such that significant water weight does not develop inside the cover. The water-tight material is preferably ABS Centrex® 401 plastic of Monsanto Company or the like. ABS Centrex® 401 plastic is a high impact ABS polymer that provides desired physical and mechanical properties and includes UV inhibitors and related compounds that resist weather aging and degradation due to hot tub environmental conditions. Furthermore, this material is lightweight, inexpensive and has good melt strength for extrusion and thermoforming. Fiberglass, for example, as in the manufacture of surfboards, and other types of substantially rigid plastic and the like, particularly those with UV and like inhibitors, may be used as an alternative to the ABS Centrex® plastic.

Outer layer 20 includes a top 21, bottom 22, hinge wall 24 and outer wall 25. The outer wall 25 may contain a plurality of sections, for example, five sections (a–e) are provided in the embodiment of FIG. 1 (a–c are visible, while d–e are cut-away on half 10). The top, bottom and outer wall of outer layer 20 are preferably 030–060 (30–60 thousandths of an inch thick) ABS plastic. The height of outer wall 25 preferably tapers from a height of approximately three inches proximate hinge 40 to a height of two inches at its outer most section, section c. This tapered design causes rain water and other accumulations to move off the surface of the hot tub cover, thereby reducing sagging and puddling on the top surface of the cover. Hinge wall 24 and its counterpart 24' preferably have a height of 3" and a thickness of approximately ⅜". The increased thickness of hinge walls 24,24' relative to the other plastic members provides both increased support at the center of the hot tub cover and adequate thickness for screwing or otherwise mounting hinge 40 thereto, as discussed below.

It should be recognized that in one embodiment of the present invention, the insulating foam is laminated with glue before it is contacted to the ABS plastic. A preferred glue is the ISOGRIP 3030D Adhesive of Ashland Chemical, Ashland, Oreg., which is a single-component 100 percent solids adhesive designed for bonding nonporous to nonporous substrates. The combination of the ABS plastic, foam and glue laminate provides a lightweight, high strength structure that permits design of a hot tub cover design using minimalistic amounts of material. The glue may also provide a water-tight barrier for the EPS insulation material. Thermal expansion buffer material (shown in FIG. 5, but not shown in FIG. 1) is preferably provided between the insulation foam and the exterior layer. While the thermal expansion buffer material is preferred (for structural integrity and some insulative value), the present invention includes embodiments without the expansion buffer material, for example, where the exterior layer (shell) and the insulation material are configured to move, at least in part, relative to one another.

Strengthening members 15 may be provided within foam 12 to provide additional support. Though members 15 could be provided in a plurality of arrangements to provide support, they are provided in the perspective of FIG. 1 as running generally parallel to hinge 40, i.e., along the greatest span dimension. Strengthening members 15 are preferably 030-060 ABS Centrex strips as high and long as their adjacent insulating material 12. Other strengthening member designs and materials are contemplated. These include plastic or metallic I-beams, Z-beams or L-beams (reinforced and non-reinforced) and members made of kiln dried hardwoods and the like. It should be recognized that the use of strengthening members 15 may be optional (depending to some extent on the span of the cover).

Figure 3:
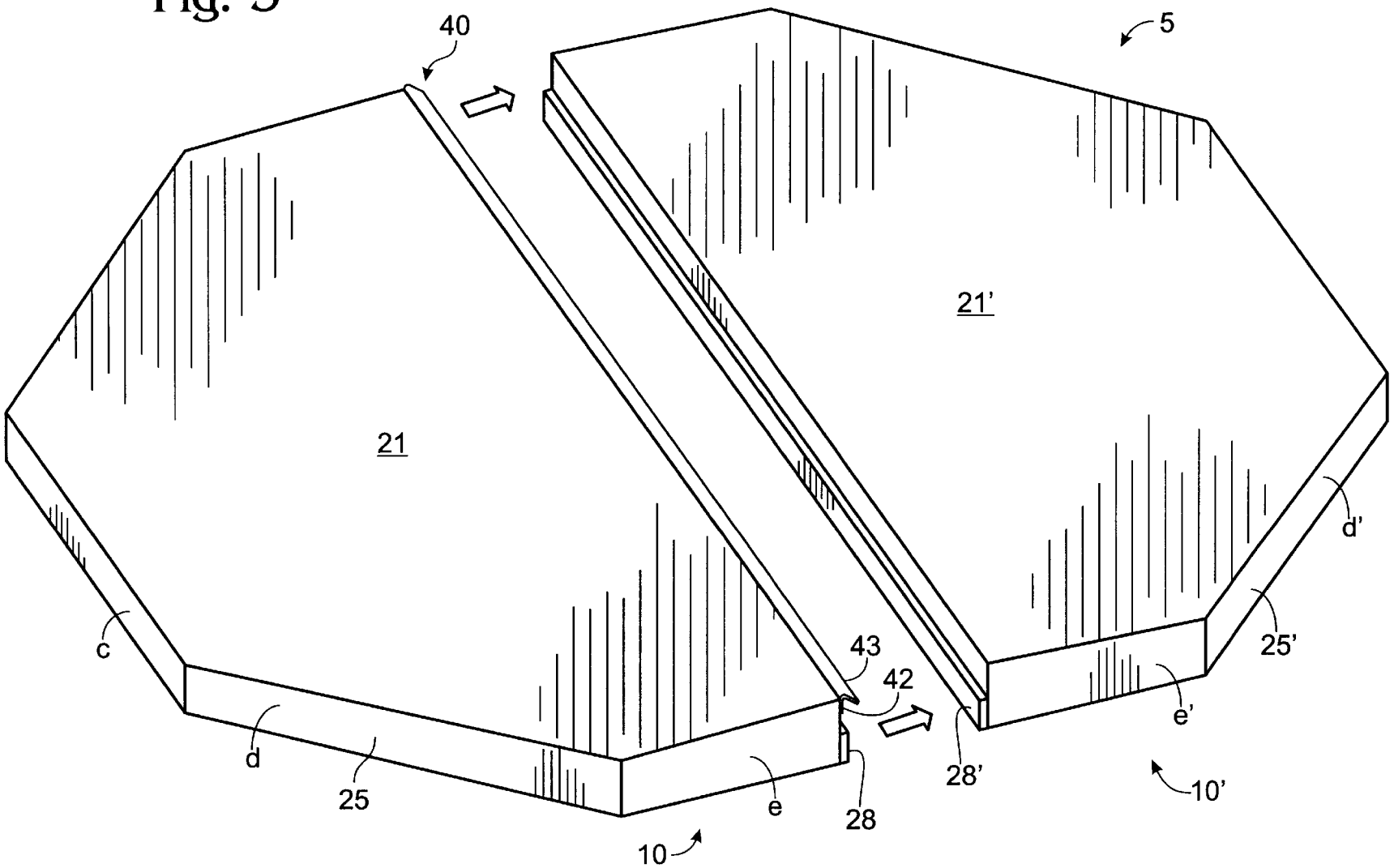
FIG. 3 is a perspective view of the two cover halves of the hot tub cover of FIG. 1 in assembly in accordance with the present invention.

The first and second halves 10,10' are joined by hinge 40 which preferably runs the common border of halves 10,10' though only a small section is shown in FIG. 1 (a more complete view of hinge 40 is shown in FIG. 3). Hinge 40 is preferably a plastic continuous piano type hinge formed of flexible alloyed polymers. Hinges of this type are available from C. E. Shepherd Company, Houston, Tex. Hinge 40 is preferably secured at hinge walls 24,24' by stainless steel screws placed at approximately three inch intervals. Alternative fastening means such as rivets and the like (including plastic rivets and glue) are also contemplated. The use of a penetrating fastener such as screws will securely attach the hinge to a side of cover top 21 and to hinge wall 24,24.

A layer of preferably dense foam rubber 28' (28 is not shown because it is compressed between the two halves 10,10' from the perspective shown in FIG. 1) or like material is preferably provided on the interior face of hinge walls 24,24' to provide a flush surface that facilitates formation of a good thermal barrier and acts as a shock absorber reducing stress on hinge 40.

Figure 2A:
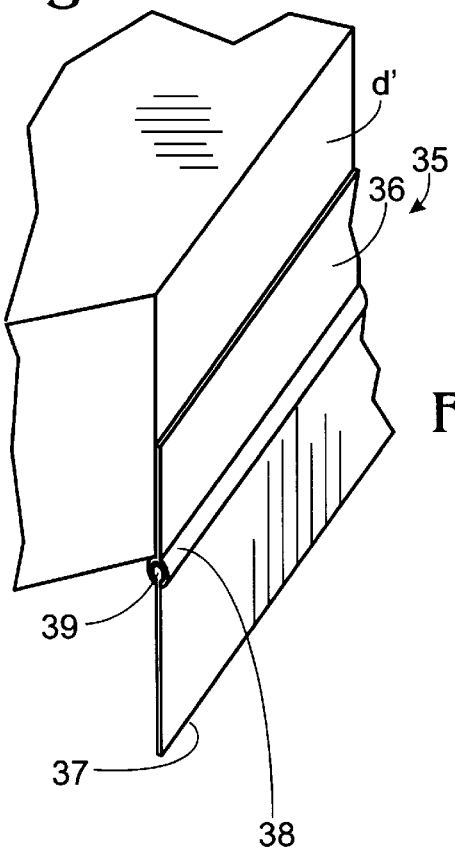
FIGS. 2A–2D are a perspective and three cross-sectional side views of apron arrangements for the hot tub cover of FIG. 1

Referring additionally to FIGS. 2A–2D, an apron 35 is preferably provided around the bottom periphery of each half of cover 5. Apron 35 preferably consists of an awning mounting member 36 (or 36B–36D) and an upholstery cord 37. Awning member 36, 36B–36D may be mounted to outer wall 25 of the cover or to bottom 22 (as discussed below with reference to FIGS. 2B–2D). The upholstery cord 37 is preferably formed of flexible vinyl that is doubled over and processed to have a bead 39 at the fold. This bead (as shown in FIG. 2A) slides into an appropriately configured receptacle 38 in the awning member. This or like apron arrangements are preferred because the flexible vinyl upholstery cord will deteriorate more rapidly than the ABS plastic and can be slid out of the receptacle and readily replaced with new vinyl. It should be recognized, nonetheless, that many apron arrangements are known and can be implemented in a hot tub cover of the present invention.

Referring to FIG. 2A, a perspective view of a section of outer wall 25' (for example, from section d') illustrating apron 35 in accordance with the present invention is shown. A bead 39 of upholstery cord 37 is slid through a receptacle 38 of awning member 36.

Figure 2B:
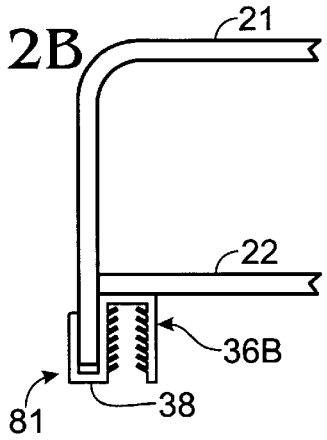
Figure 2C:
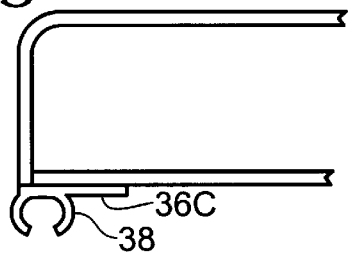
Figure 2D:
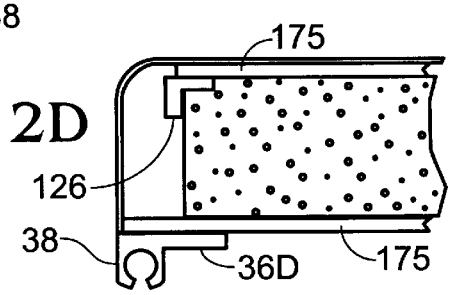

Referring to FIGS. 2B–2D, side views of alternative awning members 36B–36D are respectively shown in accordance with the present invention. An upholstery cord 37 would fit into receptacles 38. FIG. 2B illustrates in cross-section an awning member 36B that is also a joinder mechanism in that it includes a trough or other recession 81. Cover top 21 may be configured such that a side wall thereof descends past bottom section 22 into the trough. In this embodiment, trough 81 is preferably filled with glue and the side wall is then inserted into the glue within the trough to provide a reinforced water-tight seal. The recession or other joining arrangement could alternatively be formed within the top or bottom sections or otherwise formed in a awning/joining member. Recessions and penetration (or like joining arrangements) provide positive coupling (and enhanced water-tightness and structural integrity) as opposed to simple overlapping and the like.

A strip 33 of small cell foam rubber or like material is preferably placed along the underside periphery of cover 5 to compensate for surface irregularities along the cover-tub interface, thus facilitating formation of a better seal therebetween.

Referring to FIG. 3, a perspective view of the two halves of the hot tub cover of FIG. 1 in assembly in accordance with the present invention is shown. Hinge 40 preferably runs the length of the common border of halves 10,10'. During the mounting of hinge 40, a first longitudinal section 42 is aligned in an appropriate position at hinge wall 24 and affixed with screws. This generally achieves the structure of half 10 illustrated in FIG. 3. To connect the second hinge section 43, half 10 is preferably flipped up onto half 10' and section 43 is aligned in an appropriate position at hinge wall 24'. A plurality of stainless steel screws or like fastening members are driven through section 43 and an interior side wall of top section 21 into hinge wall 24' to secure hinge 40 to half 10'.

Methods of forming a hot tub cover in accordance with the present invention include a mold-based formation process. This method includes thermoforming and injection molding techniques, amongst others. To form, for example, half 10 of hot tub cover 5 by thermoforming, the following steps are preferably undertaken. A sheet of ABS Centrex® 401 plastic of appropriate thickness, that will later form top 21, and the inner (hinge) and outer walls thereof, is preferably placed on an appropriately shaped mold. The sheet is heated to approximately 400 degrees F. (or the appropriate temperature for conventional thermoforming operations) and sucked into the mold by vacuum pressure. This molded cover top is allowed to cool in the mold and then ejected with air pressure.

The top cover is placed upside down and hinge wall 24 (and 124 of FIG. 5) is preferably glued and screw fastened inside the cover top and the interior is laminated with glue. A layer of thermal expansion buffering material (discussed in more detail below with reference to FIG. 5) is then provided over the glue layer. Insulating foam with strengthening member(s) 15 is then inserted with glue being provided between the strengthening members and swathes. The exposed foam surface is then laminated with glue and another sheet of expansion buffer material is placed on the glue laminant. The precut bottom section 22 is mounted into place over the expansion buffer material. The edges of the molded top 21 and flat bottom sections 21,22 are then sealed with a structural hot melt glue and/or with a joinder device and glue as shown in FIG. 2B.

Figure 5:
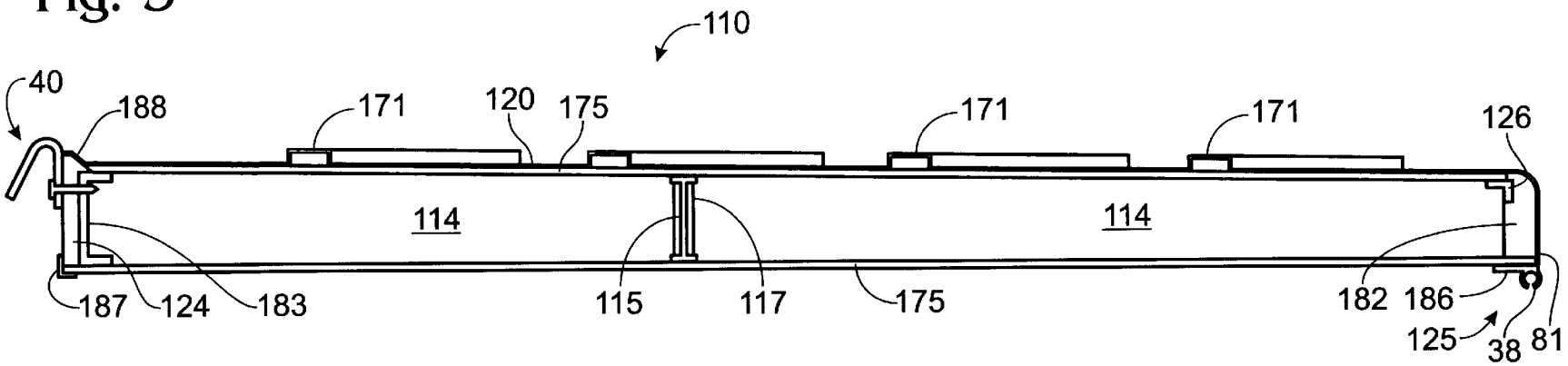
FIG. 5 is a side view of the hot tub cover half of FIG. 4 in accordance with the present invention.
Figure 4:
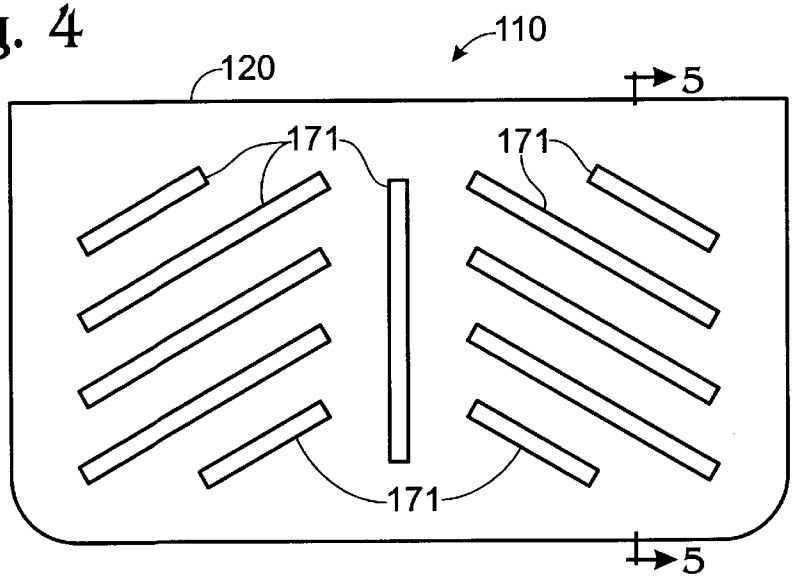
FIG. 4 is a plan view of half of a hot tub cover having thermal expansion absorbing mechanisms and a generally rectangular shape in accordance with the present invention.

Referring to FIGS. 4–5, a plan view and a more detailed cross-sectional side view, respectively, of an embodiment of a hot tub cover in accordance with the present invention is shown.

In the embodiment of FIGS. 4–5, the ABS plastic outer shell 120 is preferably formed with a plurality of hollow ridges 171. The configuration of these ridges (and the buffer material described below) permits the ABS plastic to expand and contract in response to changing thermal conditions without cracking or otherwise degrading due to thermal expansion/contraction stress.

A layer of expansion buffer material 175 such as polyurethane foam is preferably provided about the EPS insulating material 114. The expansion buffer 175 provides a buffer that compensates for different coefficients of thermal expansion between the plastic outer shell and the foam insulating material. The buffer is attached on one side to the outer shell and on the other side to the insulating foam with commercially available glue. For a hot tub cover half that contains EPS having a height of 3" at the inner wall and 2" at the periphery and a span of approximately 3.5 feet, the polyurethane foam of expansion buffer 175 is approximately ¼ of an inch thick. An expansion gap or the like 182 is preferably provided between the end of the EPS and the outer side wall.

The embodiment of FIG. 5 also illustrates supplemental strengthening members. These members include an inner wall member 124, a C-beam 183, an I-beam 115 (which may alternatively be implemented as a Z-beam or the like) and an angled member 126. The inner wall member 124, analogous to inner wall 24 of FIG. 1, is preferably formed in a pointed or half arrow shape (to form support for kick-up 188 discussed below). The C-beam preferably runs the length of the hinge to reinforce the span of the insulating material. The C-beam (and the other strengthening members) may be formed of a lightweight material such as galvanized sheet metal, aluminum, suitable plastics or the like. Hinge screws (and glue) preferably join the inner wall member 124 to the C-beam. The strengthening I-beam (or Z-beam) 115 is analogous to strengthening member 15 of FIG. 1 and is preferably formed of rigid ABS plastic or a suitable material or the like. Thin steel strips 117 or the like may be affixed along one or both sides of strengthening member 115. Angle member 126 (which may have a single or multiple angles is preferably provided along the edge of the cover half opposite the hinge wall for structural reinforcement.

An awning/joining member 186 (of the type shown in FIG. 2B) is shown joining the top and bottom sections of the cover. The awning/joining member 186 is preferably glued to the bottom section and secures the top section by way of trough 81 and glue. A simple angled joining member 187 is preferably glued to the abutted edges of the top and bottom sections along the inner or "hinge" side wall (no cover skirt is provided at the hinge).

It should be recognized that the hinge side of the cover includes a kick-up 188. This kick-up 188 is provided so that when one half of the cover is folded over onto the other half, a mechanical cover lifting device may be readily inserted between the cover halves.

Figure 6:
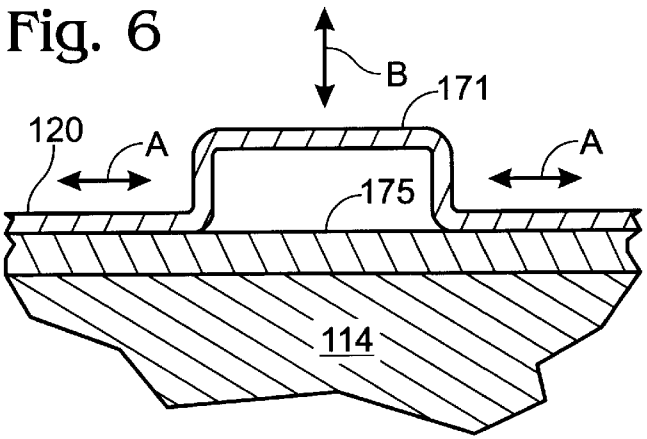
FIG. 6 is a cross-sectional side view of a thermal expansion absorbing hollow ridge in accordance with the present invention.

Referring to FIG. 6, a close-up cross-sectional side view of a thermal expansion absorbing hollow ridge in accordance with the present invention is shown. The configuration of ridge 171 and the movement provided by flexible foam 175, permits the outer shell 120 to move relative to insulating material 114. Arrows A and B indicate movement within the ridge in the horizontal and vertical directions. It should be recognized that other types of thermal expansion absorbing (compensating) mechanisms are contemplated and are within the scope of the present invention. These include (1) the formation of slots in the outer shell and the provision of compressible rubber members or flexible caulking material or the like therein, (2) the formation of hollow perturbations in the outer shell having other than linear ridge configurations and (3) related mechanisms that permit the water-tight outer shell to expand and contract relative to the insulation material without warping or cracking.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A hot tub cover, comprising:

an exterior layer that is substantially water-tight; and thermal insulation material provided within said exterior layer, wherein said exterior layer includes a mechanism that accommodates a difference in thermal coefficients of expansion between said exterior layer and said insulation material, wherein said expansion buffering mechanism includes protrusion formed in said exterior layer.

2. The cover of claim 1, wherein said protrusion substantially forms a ridge.

3. The cover of claim 1, further comprising supplemental expansion buffer material provided at least in part between said exterior layer and said insulation material.

4. The cover of claim 1, wherein said exterior layer further comprises at least a first and a second portion and said cover further comprises a joinder member coupled to said first portion and having a recession for receiving said second portion to thereby facilitate achieving said water tight characteristic between said first and second portions.

5. The cover of claim 4, wherein said joinder member further comprises a mechanism for releasably holding a cover skirt.

6. The cover of claim 1, further comprising a mechanism for releasably holding a cover skirt.

7. The cover of claim 1, further comprising a first half and a second half coupled at a hinge, wherein at least one of said halves has a height proximate said hinge that is higher than an adjacent portion of that same half such that when said first half is folded onto said second half, a gap is provided between said halves proximate said hinge.

8. The cover of claim 1, wherein said cover tapers in height from a first region to a second region to facilitate drainage of liquid off of said c over.

9. A hot tub cover, comprising:

an exterior layer of substantially rigid, water-tight material;

thermal insulation material provided within said exterior layer; and expansion buffer material provided between said exterior layer and said insulation material, said exterior layer having protrusion therein to act together with said buffer material as a buffer for different rates of thermal expansion between said exterior layer and said insulation material.

10. The cover of claim 9, wherein said expansion buffering material comprises an insulation material.

11. The cover of claim 10, wherein said exterior layer includes said expansion buffering material.

12. The cover of claim 9, wherein said insulation material and said exterior layer both include said expansion buffering material, though said expansion buffering material is different for each of said insulation material and said exterior layer.

13. The cover of claim 12, wherein said exterior layer further comprises at least a first and a second portion and said cover further comprises a joinder member coupled to said first portion and having a recession for receiving said second portion to thereby facilitate achieving said water tight characteristic between said first and second portions.

14. A hot tub cover, comprising:

an exterior layer formed of at least a first cover section and a second cover section, both of said first and second cover sections being formed of a substantially rigid, water-tight material;

thermal insulation material provided within said exterior layer;

a joinder mechanism coupled to at least one of said first and second sections where said first and second cover sections come together around said insulation material, said joinder mechanism being configured to define a recess that permanently receives a portion of the other of said first and second cover sections to thereby form a substantially watertight seal at said recess, and a mechanism coupled to said layer adjacent the periphery of a hot tub and having an elongated open channel for holding an edge of a cover skirt, and said cover skirt releasably held in said channel and depending downwardly of said cover when covering said hot tub.

15. A hot tub cover, comprising:

a substantially water-tight exterior layer adapted to cover a hot tub;

thermal insulation material provided within said exterior layer, wherein at least one of said exterior layer and said insulation material includes a mechanism that accommodates a difference in thermal coefficients of expansion between said exterior layer and said insulation material; and a mechanism coupled to said exterior layer adjacent to the periphery of said hot tub and having an elongated open channel for holding an edge of a cover skirt, and said cover skirt releasably held in said channel and depending downwardly of said cover when covering said hot tub.

* * * * *